US006031329A

United States Patent [19]

Nagano

[11] Patent Number: 6,031,329

[45] Date of Patent: Feb. 29, 2000

[54] PLASMA DISPLAY PANEL

[75] Inventor: Shinichiro Nagano, Tokyo, Japan

[73] Assignee: Mitsubishi Denki Kabushiki Kaisha, Tokyo, Japan

[21] Appl. No.: 09/049,206

[22] Filed: Mar. 27, 1998

[30] Foreign Application Priority Data

Mar. 31, 1997 [JP] Japan ..... 9-080609
Feb. 25, 1998 [JP] Japan ..... 10-043848

[51] Int. Cl.[7] ..... H01J 17/49

[52] U.S. Cl. ..... 313/582; 313/583; 313/584; 313/585

[58] Field of Search ..... 313/491, 582, 313/583, 584, 585, 586, 587, 620, 631

[56] References Cited

U.S. PATENT DOCUMENTS 5,952,782 9/1999 Nanto et al. ..... 313/584

FOREIGN PATENT DOCUMENTS 3-187125 8/1991 Japan .
5-135701 6/1993 Japan .
9-102280 4/1997 Japan .

*Primary Examiner*—Vip Patel

[57] ABSTRACT

The invention provides a plasma display panel having an improved light emission contrast. The plasma display panel includes a plurality of discharge sustaining electrode pairs $X_n$ and $Y_n$ each comprising discharge sustaining electrodes $x'_n$ and $x_n$, and $y_n$ and $y'_n$, respectively, which are electrically isolated from each other and which extend in a direction along the scanning lines. The plasma display panel also includes discharging cells in which a discharge occurs within a region limited between the discharge sustaining electrodes $x_n$ and $y_n$ in the first and second priming periods, small-width erasing periods, and writing periods. The black-level intensity can be reduced without causing an increase in the power dissipation and a significant decrease in the normal light emission intensity. Thus, the light emission contrast is improved to a great extent without having to increase the maximum light emission intensity.

11 Claims, 9 Drawing Sheets

PLASMA DISPLAY PANEL

BACKGROUND OF THE INVENTION

1. Field of the Invention

The present invention relate to a plasma display panel provided with electrodes having a structure bringing about an improvement in the contrast of light emission on the display screen.

2. Description of the Related Art

FIG. 3 illustrates the structure of a plane-emission plasma display panel according to a conventional technique.

In FIG. 3, there are provided stripe-shaped discharge-sustaining electrodes $X_n$ and $Y_n$ formed on a front glass plate 1. Although discharge sustaining electrodes are disposed in the order . . . , $X_n$, $Y_n$, $X_{n+1}$, $Y_{n+1}$, . . . in the specific example shown in FIG. 3, they may also be disposed in the order such as . . . , $Y_n$, $X_n$, $Y_{n+1}$, $X_{n+1}$, . . . to achieve the same functions. The discharge sustaining electrodes $X_n$ and $Y_n$ each comprise a transparent electrode 2 and a bus electrode 3 for supplying electric power to the transparent electrode 2. The discharge sustaining electrodes $X_n$ and $Y_n$ are covered with a dielectric layer 4 on which there is provided a cathode film 5 made up of a MgO film serving as a discharging cathode.

On the cathode film 5, there are provided partition walls 7 extending in a direction perpendicular to the discharge sustaining electrodes $X_n$ and $Y_n$ so that discharging spaces 6 are isolated from each other by the partition walls 7. Address electrodes 8 for selecting a light emission region in the discharging spaces 6 are formed between adjacent partition walls 7 in such a manner that the address electrodes 8 extend in a direction parallel to the partition walls 7. Each discharging spaces 6 are filled with a mixed gas of Ne and Xe.

Furthermore, three-color phosphors 9 are disposed periodically in the order red 9R, green 9G and blue 9B on the surfaces, on the sides facing the respective discharging spaces, of the partition walls and the address electrodes 8. Furthermore, as shown in FIG. 3, there is also provided a back side glass plate 10 on the partition walls and the address electrodes 8.

An nth scanning line is formed by the discharge sustaining electrodes $X_n$ and $Y_n$. In the discharging spaces 6, a discharging cell in which a discharge occurs is formed at each intersection of the scanning lines and the address electrodes. That is, the plasma display panel has the structure in which discharging cells are disposed in a matrix fashion.

FIG. 4 illustrates a cross section of the conventional plasma display panel, taken along a plane perpendicular to the scanning lines. For simplicity, the partition walls 7, the address electrodes, 8, the phosphors 9R, 9G, and 9B, and the back side glass plate 10 are not shown in FIG. 4.

In FIG. 4, by way of example, dimensions typical for a 40 inch VGA-type plasma display panel are also shown, wherein the values are expressed in $\mu$m. As shown in FIG. 4, the nth scanning line is located at the center between a pair of discharge sustaining electrodes $X_n$ and $Y_n$.

The operation of the conventional plasma display panel is described below.

FIG. 5 illustrates an example of the manner in which a frame is divided into a plurality of fields so that a color image with 256 halftone levels is represented therein.

In this example, one main frame consists of eight subfields (first SF to eighth SF). Each subfield consists of a first priming period (I), a second priming period (II), a small-width erasing period (III), a writing period (IV), and a discharge sustaining period (V).

In any subfield, the periods I-IV are equal in length of time. However, the discharge sustaining period (V) varies in accordance with the rank defined for each subfield. The discharge sustaining period (V) of the (N+1)th subfield is about twice that of the nth subfield (wherein N is a natural number). In the writing period (IV) of each subfield, a desired cell is selected by applying a pulse-shaped voltage to a corresponding address electrode 8. During the following discharge sustaining period (V), a sustaining discharge occurs as many times as the number of sustaining pulses applied during the discharge sustaining period (V). Therefore, the length of the discharge sustaining period (V) is proportional to the number of sustaining pulses.

As a result, the intensity of light emission which occurs in the cell selected in the writing period (IV) increases about twice at each transition from any subfield to the following subfield. In the main frame, the respective subfields are either selected or not selected so as to achieve any arbitrary halftone level selected from $2^8$=256 levels.

FIG. 6 is a timing chart illustrating an example of a sequence of pulses applied, in each subfield, to the address electrodes (W electrodes) and the discharge sustaining electrodes $X_n$ and $Y_n$.

After passing through the first priming period (I) and further the second priming period (II), a priming discharge occurs between the discharge sustaining electrodes $X_n$ and $Y_n$ in all discharging cells. In the subsequent small-width erasing period (III), an erasing discharge occurs between the discharge sustaining electrodes $X_n$ and $Y_n$. thereby removing most of charges present on the surface of the cathode film 5 at locations above the discharge sustaining electrodes $X_n$ and $Y_n$. As a result, information stored in the discharging cell selected in the previous subfield is reset.

In the following writing period (IV), the voltage of the discharge sustaining electrode $Y_n$ is swung from one scanning line to another. In synchronization therewith, a selected/non-selected image signal is applied to the W electrode of the respective cells so that a writing discharge occurs between Xn and $Y_n$ in the selected cells. In the discharging cells in which the writing discharge has occurred, a sustaining discharge occurs as many times as the number of sustaining pulses applied to the discharge sustaining electrodes $X_n$ and $Y_n$ during the following discharge sustaining period (V). On the other hand, in the discharging cells which were not selected in the writing period (IV), no sustaining discharge occurs during the sustaining period (V). By properly selecting discharging cells in the manner described above, a desired image is produced.

In the plasma display panel, the discharging cells which were not selected during the writing period (IV) have no discharge during the discharge sustaining period (V) as described above, and thus black is displayed in these non-selected discharging cells.

The image becomes sharper and clearer with the ratio (light emission contrast) of the light emission intensity (maximum brightness) of the discharge in the discharging cells selected in the writing period (IV) to the black-level intensity of the discharging cells which were not selected in the writing period (IV). In other words, to improve the image quality of the plasma display panel, it is required to increase the light emission contrast.

One possible way of increasing the light emission contrast is to generally increase the number of sustaining pulses applied during the discharge sustaining period (V) thereby increasing the maximum light emission intensity thus increasing the contrast. However, this technique results in an increase in the power dissipation and also an increase in the amount of heat generated in the plasma display panel. Therefore, this technique has a limitation in the maximum light emission contrast.

In the operating sequence described above, "black" is displayed by not selecting the discharging cell of interest during the writing period (IV) in any subfield. However, even in the discharging cells which were not selected during the writing period (IV), a priming discharge and erasing discharge still occur in the first and second priming periods (I, II) and the erasing period (III), respectively. This makes it difficult to decrease the black-level intensity.

Furthermore, as shown in FIG. 4, the priming discharge and the erasing discharge during the first and second priming periods (I, II) and the small-width erasing period (III) occur over the entire width of the discharge sustaining electrodes $X_n$ and $Y_n$ as in the case of the sustaining discharge during the discharge sustaining period (V). In particular, in the second priming period (II) and the small-width erasing period (III), pulses with a large amplitude are applied between the discharge sustaining electrodes $X_n$ and $Y_n$, and thus the intensity of light emission generated by one discharge during these periods is generally greater than the intensity of light emission generated by one discharge in the discharge sustaining period.

For the above reason, the maximum light emission contrast practically achieved in the conventional plasma display panel is about 50:1. However, the light emission contrast of 50:1 is not high enough to represent fine difference in the light emission intensity in the low halftone-level range. As described above, the conventional plasma display panel has the problem that it is difficult to achieve a high enough light emission contrast without causing an increase in the power dissipation or an increase in heat generated in the plasma display panel.

Thus, it is an object of the present invention to provide a plasma display device having an improved light emission contrast without encountering a significant increase in the power dissipation and heat generation.

SUMMARY OF THE INVENTION

According to an aspect of the present invention, there is provided a plasma display panel comprising: a back side glass plate on which there is provided an address electrode; a front glass plate located opposite to the back side glass plate; andapluralityofdischarge sustaining electrode pairs provided on the front glass plate in such a manner that they extend along scanning lines perpendicular to the address electrode, wherein the discharge sustaining electrodes $X_n$ and $Y_n$ of each discharge sustaining electrode pair comprise discharge sustaining electrodes $x'_n$ and $x_n$, and $y_n$ and $y'_n$, respectively, which are electrically isolated from each other and which extend in a direction along the scanning lines.

In a preferred form of the invention, the discharge sustaining electrodes $x_n$ and $y_n$ have the property of blocking light, and the discharge sustaining electrodes $x'_n$ and $y'_n$ are provided with a transparent electrode.

In accordance with another aspect of the present invention, the electrically isolated discharge sustaining electrodes are disposed in the order $x'_n$, $x_n$, $y_n$, $y'_n$ or in the order $y'_n$, $y_n$, $x_n$, $x'_n$, in a direction in which the scanning line number n increases (where n is a natural number).

In accordance with a further aspect of the present invention, when a priming pulse and an erasing pulse are applied to the discharge sustaining electrodes $x_n$ and $y_n$ in driving operation, the priming pulse and the erasing pulse are not always applied to the discharge sustaining electrodes $x'_n$ and $y'_n$.

In a further preferred form of the present invention, no erasing pulse is applied to the discharge sustaining electrodes $x'_n$ and $y'_n$.

In a still further preferred form of the present invention, a priming pulse is applied to the discharge sustaining electrodes $x'_n$ and $y'_n$ only in one subfield of each main frame consisting of a plurality of subfields.

In accordance with a still further aspect of the invention, a series of main frames each consisting of a plurality of subfields is constructed so that in some of the main frames no priming pulse is applied to the discharge sustaining electrodes $x'_n$ and $y'_n$.

In accordance with a yet further aspect of the present invention, when image data is written via the address electrode while sequentially scanning the scanning lines, a discharge occurs only in the region limited between the discharge sustaining electrodes $x_n$ and $y_n$ and the discharge sustaining electrodes $x'_n$ and $y'_n$ make no contribution to the discharge.

In a further preferred formof the present invention, the plasma display panel further includes a dielectric layer covering the discharge sustaining electrode pair $X_n$ and $Y_n$; and a protective film covering the dielectric layer, wherein passivation films are formed of a material passive to discharging on the back-side surface of the protective film in such a manner that each passive film extends along each boundary between adjacent scanning lines.

In a further preferred form of the present invention, first types of scanning lines and second types scanning lines are alternately disposed wherein each first type of scanning line comprises electrically isolated discharge sustaining electrodes disposed in the order $x'_n$, $x_n$, $y_n$ in a direction in which the scanning line number n increases and wherein each second type of scanning line comprises electrically isolated discharge sustaining electrodes disposed in the order $y'_n$, $y_n$, $x_n$, and $x'_n$ in the direction in which the scanning line number n increases.

In a further preferred form of the present invention, at least either discharge sustaining electrode $x'_n$ or $y'_n$ includes a part located at the boundary between adjacent scanning lines and shared by the adjacent scanning lines.

DESCRIPTION OF THE PREFERRED EMBODIMENTS

First Embodiment

Figure 1:
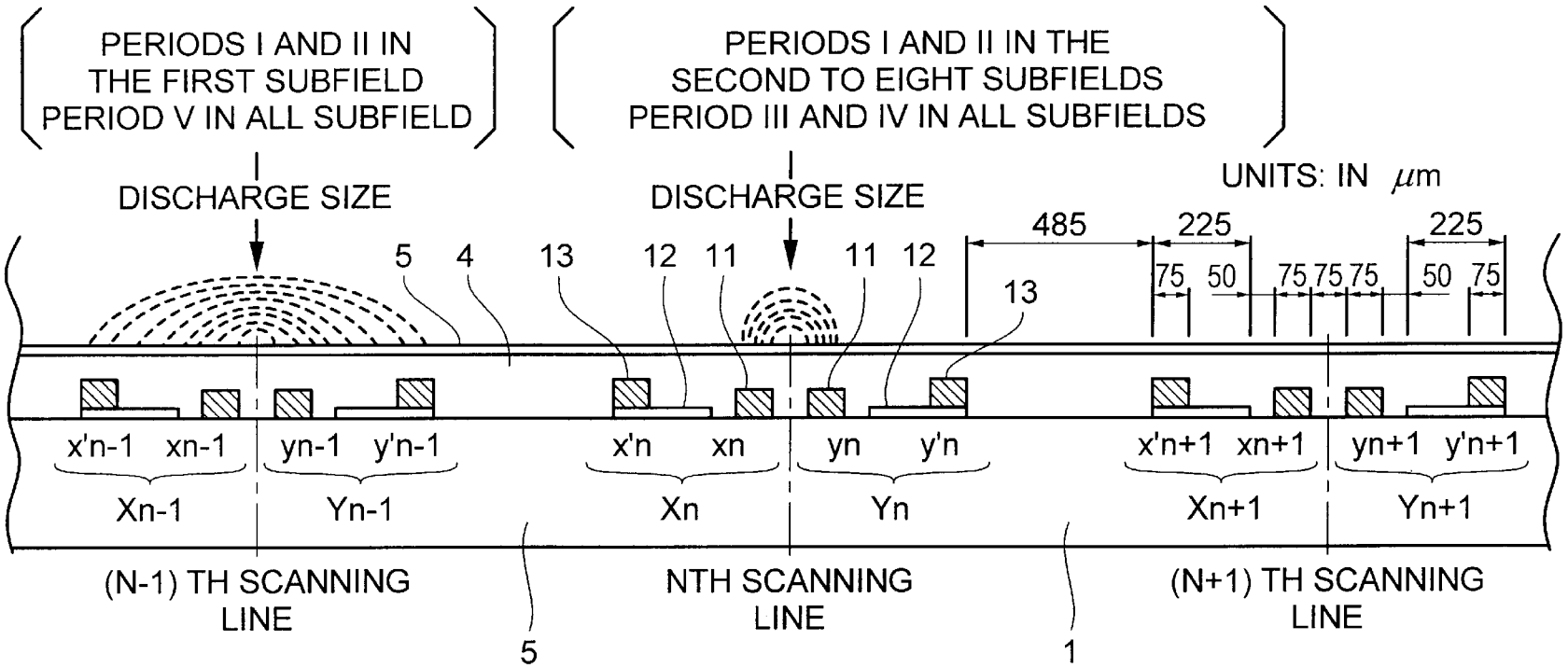
FIG. 1 is a cross-sectional view schematically illustrating the structure of a plasma display device according to a first embodiment of the present invention.

FIG. 1 is a cross-sectional view schematically illustrating the structure of a plasma display device according to a first embodiment of the present invention.

As shown in FIG. 1, there are provided a plurality of pairs of discharge sustaining electrodes $X_n$ and $Y_n$ on a front glass plate 1. The discharge sustaining electrodes $X_n$ and $Y_n$ comprise discharge sustaining electrodes $x'_n$ and $x_n$ and $y_n$ and $y'_n$, respectively, each extending in a direction along the scanning line, wherein $x_n$ and $y_n$ are electrically isolated from each other and $x'_n$ and $y'_n$ are also electrically isolated from each other. Although in the present embodiment the electrically isolated discharge sustaining electrodes are disposed in the order $x_n$, $x'_n$, $y_n$, and $y'_n$ in a direction toward a greater value of scanning line number n, they may also be disposed in the order $y'_n$, $y_n$, $x_n$, and $x'_n$ to achieve the same functions.

As shown in FIG. 1, the discharge sustaining electrodes $x_n$ and $y_n$ are spaced 75 $\mu$m apart from each other via the nth scanning line. At locations which are 50 $\mu$m apart, in a direction opposite to the nth scanning line, from the respective discharge sustaining electrodes $x_n$ and $y_n$, there are provided discharge sustaining electrodes $x'_n$ and $y'_n$, respectively. The discharge sustaining electrodes $x_n$ and $y_n$ each consist of an opaque bus electrode 11 formed of metal. The discharge sustaining electrodes $x'_n$ and $y'_n$ each consist of a transparent electrode 12 and an opaque bus electrode 13 formed of metal, wherein the bus electrode 13 is located on the side, opposite to the nth scanning direction, of the transparent electrode 12.

These discharge sustaining electrodes $X_n$ and $Y_n$ are covered with a dielectric layer 4 on which there is formed a cathode film 5 made of MgO.

On the cathode film 5, although not shown in FIG. 1, there are also provided, as in the conventional plasma display panel, partition walls for isolating discharging spaces from each other, address electrodes disposed between adjacent partition walls, three-color phosphors (red, green, blue), and a back side glass plate. In FIG. 1, by way of example, dimensions typical for 40 inch VGA-type plasma display panels are also described, wherein the values are all expressed in $\mu$m. Dimensions described elsewhere in this invention are also in $\mu$m.

Figure 2:
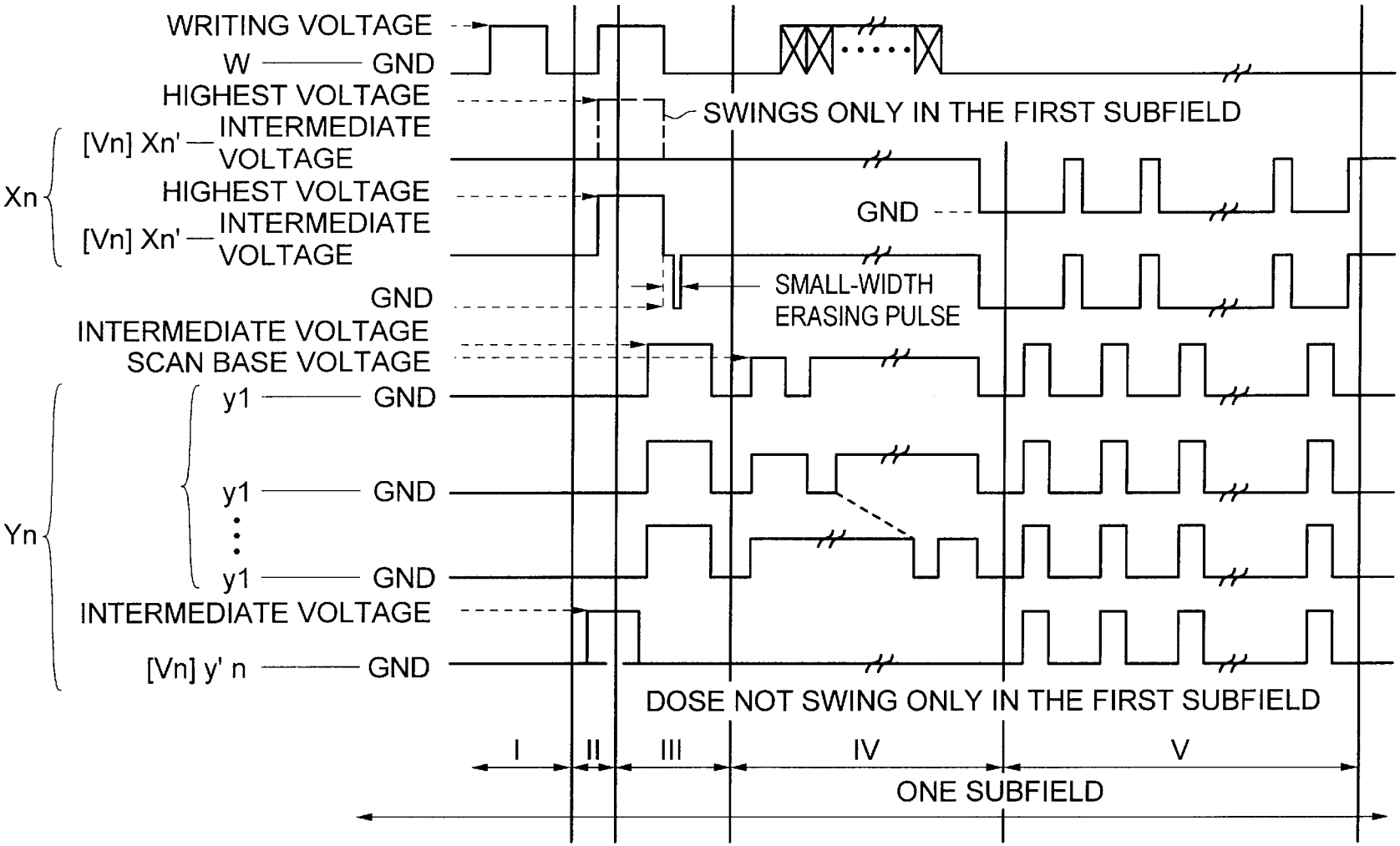
FIG. 2 is a time chart representing a time sequence of pulse voltages which are applied to the respective electrodes so as to drive the plasma display panel according to the first embodiment of the invention.
Figure 3:
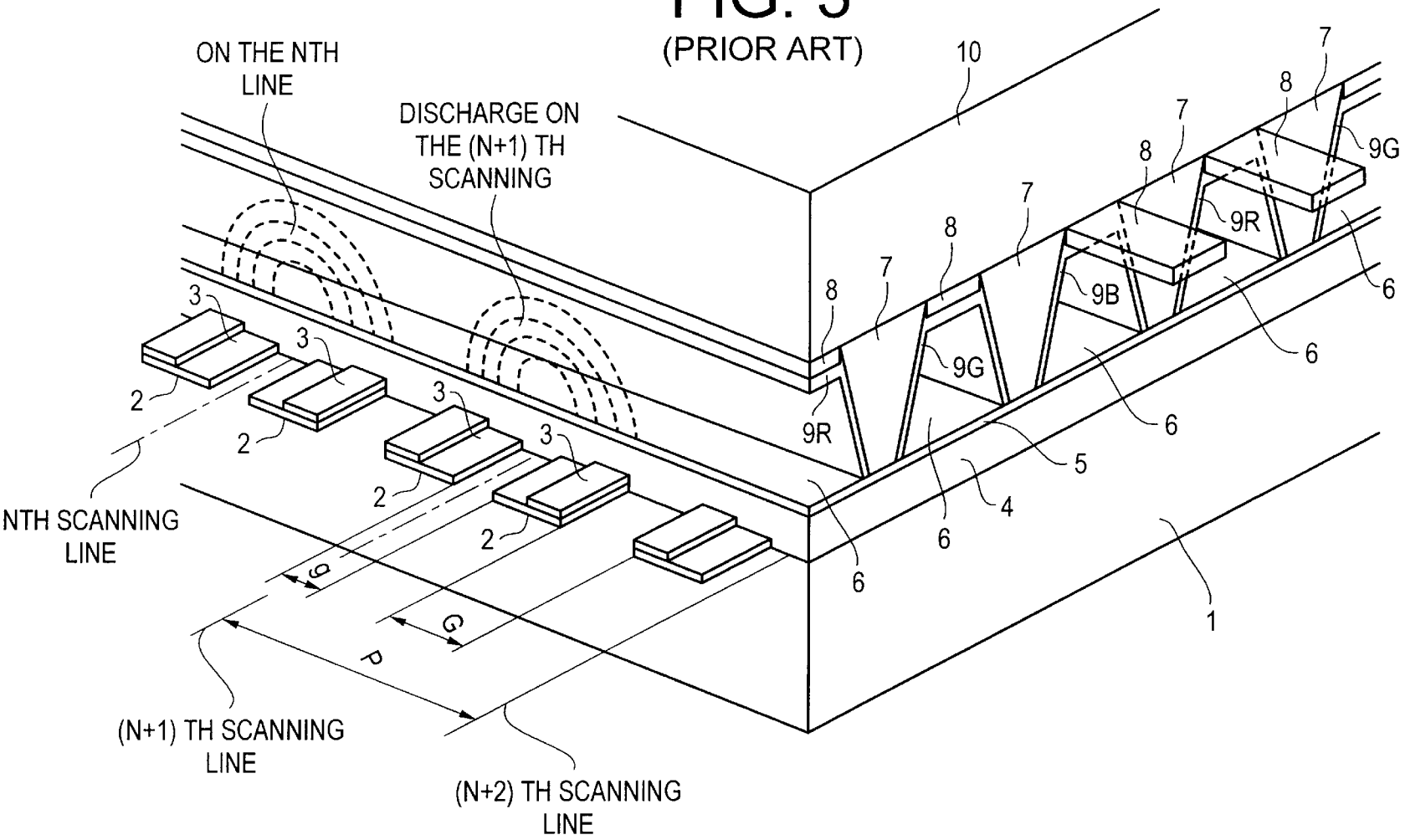
FIG. 3 (PRIOR ART)
FIG. 3 illustrates the structure of a plane-emission plasma display panel according to a conventional technique.
Figure 5:
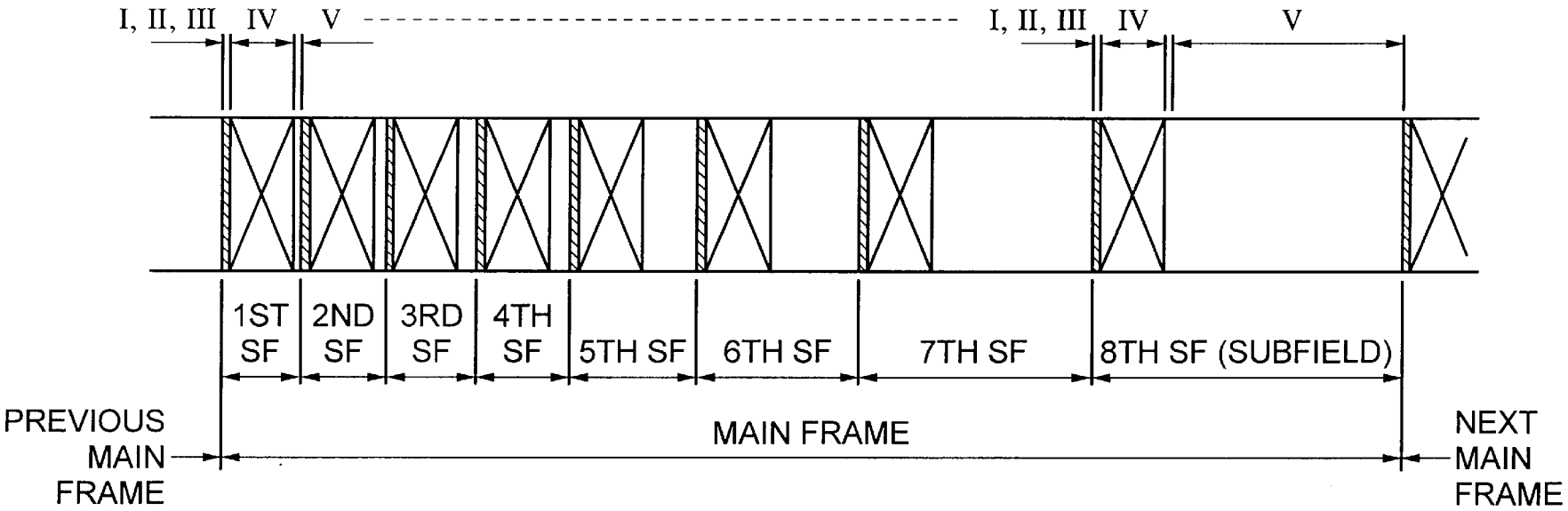
FIG. 5 (PRIOR ART)
FIG. 5 illustrates an example of the manner in which a frame is divided into a plurality of fields so that a color image with 256 halftone levels is represented therein.

FIG. 2 is a time chart representing a time sequence of pulse voltages which are applied to the respective electrodes so as to drive the plasma display panel according to the first embodiment of the invention. The image frame is divided into a plurality of fields in the same manner as in the conventional plasma display panel (refer to FIG. 5).

As shown in FIG. 2, the sequence of pulse voltages applied to the address electrode 8 are similar to those employed in the conventional technique (described earlier with reference to FIG. 6). The sequence of pulse voltages applied to the discharge sustaining electrodes $x_n$ and yn are also similar to those applied to the discharge sustaining electrodes $X_n$ and $Y_n$ of the conventional plasma display panel (refer to FIG. 6). On the other hand, to the discharge sustaining electrodes $x'_n$ and $y'_n$, a sequence of pulse voltages are applied independently of those applied to the discharge sustaining electrodes $x_n$ and $y_n$.

The operation of the plasma display panel according to the first embodiment of the invention is described below.

During the first priming period (I) and the second priming period (II) in the first subfield, the voltages of the discharge sustaining electrodes $x'_n$ and $y'_n$ vary in the same manner as those of the discharge sustaining electrodes $x_n$ and $y_n$ as represented by the alternate long and short dash line in FIG. 2 (the voltages applied to the discharge sustaining electrodes $x'_n$ vary in the manner described by the alternate long and short dash line only in the first subfield, and they vary in the manner described by the solid line in the second subfield and other subfields following that).

In this situation, because the discharge sustaining electrodes $x'_n$ and $y'_n$ have the same voltage as those of the discharge sustaining electrodes $x_n$ and $y_n$, respectively, and because the gap between the discharge sustaining electrodes $x_n$ and $y_n$ is as small as 50 $\mu$m, the potential of the surface of the cathode film 5 at the locations above the discharge sustaining electrodes $x_n$ and $x'_n$ and that at the locations above the discharge sustaining electrodes $y_n$ and $y'_n$ are determined mainly by the potential of the discharge sustaining electrodes $x_n$ and $x'_n$ and that of the discharge sustaining electrodes $y_n$ and $y'_n$ without having substantially no influence of the potential of the address electrode 8 separated by the discharging space 6 from the discharge sustaining electrodes.

As a result, the voltages of the discharge sustaining electrodes $x_n$ and $x'_n$ become greater than those of the discharge sustaining electrodes $y_n$ and $y'_n$. Thus, an electric field is developed between the discharge sustaining electrodes $x_n$ and $y_n$ and the discharge sustaining electrodes $x'_n$ and $y'_n$ in a direction from the discharge sustaining electrodes $x_n$ and $x'_n$ toward the discharge sustaining electrodes $y_n$ and $y'_n$.

In this situation, if a priming discharge starts, in the first and second priming periods (I, II) of the first subfield, at the location above the gap (75 $\mu$m) between the discharge sustaining electrodes $x_n$ and $y_n$ where a highly concentrated electric field is developed, the discharge grows into a greater size extending over the entire width of the discharge sustaining electrodes $X_n$ and $Y_n$. The size of a grown discharge is schematically illustrated at the (n−1)th scanning line in FIG. 1.

In this case, as described above, the priming discharge during the second priming period occurs in the great region in which the discharge sustaining electrodes $x'_n$ and $y'_n$ also make a contribution to the priming discharge. The surface areas of the discharge sustaining electrodes $X_n$ and $Y_n$ are nearly equal to those of the conventional discharge sustaining electrodes $X_n$ and $Y_n$, and thus the discharge grown into the great size has an intensity similar to that which occurs between the conventional discharge sustaining electrodes $X_n$ and $Y_n$.

The major part of the width of each discharge sustaining electrode $x'_n$ and $y'_n$ is occupied by the transparent electrode 12. Therefore, light emitted from the phosphor 9 excited by the discharge passes through an aperture having a size similar to that of the conventional discharge sustaining electrodes $X_n$ and $Y_n$. This means that the intensity of visible light emission is as large as that achieved by the discharge sustaining electrodes constructed into the conventional structure.

At the end of the second priming period of the first subfield, there is a negative charge stored on the surface of the cathode film at the location above the discharge sustaining electrodes $X_n$ and $x'_n$, and a positive charge above the discharge sustaining electrodes $y_n$ and $y'_n$.

Figure 6:
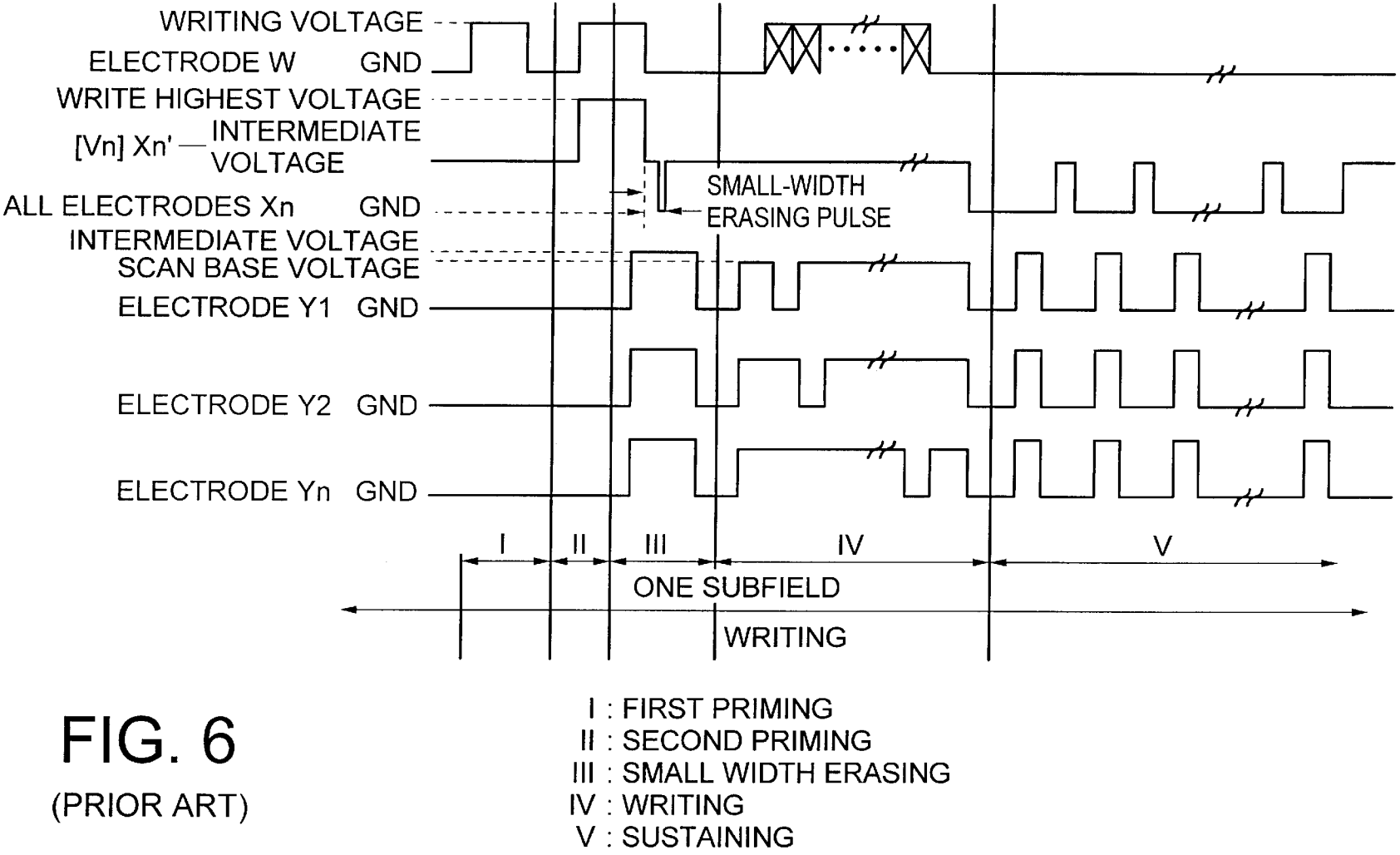
FIG. 6 (PRIOR ART)
FIG. 6 is a timing chart illustrating an example of a sequence of pulses applied, in each subfield, to the address electrodes (W electrodes) and the discharge sustaining electrodes $X_n$ and $Y_n$ according to a conventional technique.

After that, the operation proceeds to the small-width erasing period (III) of the first subfield. As described above, the sequence of pulses similar to that shown in FIG. 6 is input to the address electrodes 8, and the sequence of pulses similar to that applied to the conventional discharge sustaining electrodes $X_n$ and $Y_n$ is applied to the discharge sustaining electrodes $x_n$ and yn, respectively. Thus, an erasing discharge occurs between the discharge sustaining electrodes $x_n$ and $y_n$ thereby erasing most of charges which have been stored, through the first and second priming periods (I, II), on the surface of the cathode film 5 at the locations above the discharge sustaining electrodes $x_n$ and $y_n$.

The erasing discharge occurs when a small-width erasing pulse applied to the discharge sustaining electrodes x swings from the highest voltage to the GND voltage in the small-width erasing period (III) shown in FIG. 2. In order for the erasing discharge to occur, the discharge sustaining electrode $y_n$ needs to be at an intermediate voltage. To meet this requirement, the voltage applied to the discharge sustaining electrode $y_n$ is increased from GND to the intermediate voltage prior to applying the small-width erasing pulse. On the other hand, when the small-width erasing pulse is applied to the discharge sustaining electrode $x_n$, the discharge sustaining electrode $y'_n$ is at GND while the discharge sustaining electrode $x'_n$, to which the small-width erasing pulse is not applied, remains at the intermediate voltage. Therefore, the discharge sustaining electrodes $x'_n$ and $y'_n$ make no contribution to the erasing discharge. As a result, the erasing discharge occurs in a small region limited between the discharge sustaining electrodes $x_n$ and $y_n$ (as illustrated at the nth scanning line in FIG. 1).

This small discharge occurs at a low intensity level and thus light emission from the phosphor 9 occurs at a corresponding low level. Besides, most of light emitted from the phosphor 9 is blocked by the opaque bus electrodes 11 made of metal forming the discharge sustaining electrodes $x_n$ and $y_n$. As a result, the intensity of light arising from the erasing discharge, which is visible from the front side of the plasma display panel, becomes very low. Thus, the influence of the erasing discharge on the light emission contrast becomes extremely small.

The negative and positive charges, which have been stored, through the first and second priming periods (I, II), on the surface of the cathode film 5 at the locations above the discharge sustaining electrodes $x'_n$ and $y'_n$, respectively, remain there at the end of the small-width erasing period (III) of the first subfield.

Then the operation proceeds to the writing period (IV) of the first subfield. In this writing period (IV), a sequence of pulse voltages is applied to the address electrode 8 in a similar manner to the conventional technique, and a sequence of pulse voltages is applied to the discharge sustaining electrodes $x_n$ and $y_n$ in a similar manner to that applied to the discharge sustaining electrode $X_n$ and $Y_n$ having the conventional structure. In response to an image signal applied to the address electrode 8, a light emission region is selected and a writing discharge occurs selectively between the discharge sustaining electrodes $x_n$ and $y_n$. However, the voltage of the discharge sustaining electrode $y'_n$ is maintained at GND and there is a positive charge on the surface of the cathode film 5 at the corresponding location, and the voltage of the discharge sustaining electrode $x'_n$ is maintained at the intermediate voltage and there is a negative charge on the surface of the cathode film 5 at the corresponding location. Therefore, the discharge sustaining electrodes $x'_n$ and $y'_n$ make no contribution to the writing discharge.

As a result, the writing discharge occurs in a small region limited between the discharge sustaining electrodes $x_n$ and $y_n$. Thus, at the end of the writing period (IV) of the first subfield, negative and positive charges remain on the surface of the cathode film 5 at the locations above the discharge sustaining electrodes $x_n$ and $y_n$ in the discharging cell in which the writing discharge occurred in response to the image signal (i.e., in the discharge cell selected by the address electrode). On the other hand, in the discharge cells in which no writing charge occurred (i.e., in the discharge cells which were not selected by the address electrode), there is no such charge remaining on the surface of the cathode film 5 at the locations above the discharge sustaining electrodes $x_n$ and $y_n$.

On the other hand, at locations above the discharge sustaining electrodes $x'_n$ and $y'_n$, almost all the negative and positive charges which have been stored through the first and second priming periods (I, II) remain on the surface of the cathode film 5 in all discharge cells regardless of whether the image signal was applied or not.

Then the operation proceeds to the discharge sustaining period (V) of the first subfield. At the beginning of the discharge sustaining period (V), the discharge sustaining electrodes $x_n$, $y_n$, $x'_n$, and $y'_n$ are all at the GND voltage. In the discharge cells in which the writing discharge occurred in the writing period (IV), the negative charge remains at the locations above the discharge sustaining electrodes $x_n$ and $x'_n$, and the positive charge remains at the locations above the discharge sustaining electrodes $y_n$ and $y'_n$. If the voltage of the discharge sustaining electrodes $y_n$ and $y'_n$ is increased to the intermediate voltage, the application of the intermediate voltage in addition to the presence of the remaining charge results in creation of a strong electric field in the discharging space at the location above the gap between the discharge sustaining electrodes $x_n$ and $y_n$. As a result, a first large-size discharge occurs between the discharge sustaining electrodes $X_n$ and $Y_n$.

The above discharge occurs in the same manner as that in the first and second priming periods (I, II) of the first subfield, and thus the discharge occurs in a large region over the entire width of the discharge sustaining electrodes $x_n$, $x'_n$, $y_n$, and $y'_n$ (i.e., over the entire width of the discharge sustaining electrodes $X_n$ and $Y_n$). This first sustaining discharge ends when a certain among of positive charge has been stored at the location above the discharge sustaining electrode $X_n$ through the discharge and a certain amount of negative charge has been stored at the location above the discharge sustaining electrode $Y_n$. Thus, certain amounts of positive and negative charges remain at the locations above the discharge sustaining electrodes $x_n$ and $x'_n$, and $y_n$ and $y'_n$, respectively.

After that, the voltage of the discharge sustaining electrode $Y_n$ is returned to GND, and then the voltage of the discharge sustaining electrode $X_n$ is swung to the intermediate voltage. At this stage, the charges on the cathode film 5 and the voltages of the respective sustaining electrodes all become opposite in polarity to those in the first sustaining discharge. That is, there is a positive charge stored at the location above the discharge sustaining electrodes $x_n$ and $x'_n$, and a negative charge stored at the location above the discharge sustaining electrodes $y_n$ and $y'_n$. If the voltages of the discharge sustaining electrodes $x_n$ and $x'_n$ are both increased to the intermediate voltage while maintaining the discharge sustaining electrodes $y_n$ and $y'_n$ at GND, the application of the intermediate voltage in addition to the presence of the stored charge results in creation of a strong electric field in the discharging space at the location above the gap between the discharge sustaining electrodes $x_n$ and $y_n$. Thus, following the first discharge, a second large-size discharge occurs between the discharge sustaining electrodes $X_n$ and $Y_n$.

The second sustaining discharge ends when a certain amount of negative charge has been stored at the location above the discharge sustaining electrode $X_n$ through the discharge and a certain amount of positive charge has been stored at the location above the discharge sustaining electrode $Y_n$. The above operation is performed repeatedly so that a large-size sustaining discharge occurs each time a pulse is applied alternately to the discharge sustaining electrodes $X_n$ and $Y_n$.

In the discharging cells in which no writing discharge occurred in the writing period (IV), there are no similar charges at the locations above the discharge sustaining electrodes $x_n$ and $y_n$. Therefore, when the voltages of the discharge sustaining electrodes $y_n$ and $y'_n$ are both increased to the intermediate voltage, the electric field does not become strong enough to start a discharge in the discharging space at the location above the gap between the discharge sustaining electrodes $x_n$ and $y_n$. As a result, no sustaining discharge occurs in these discharging cells,. In these cells, no discharge occurs when a pulse is applied to the discharge sustaining electrode $X_n$ or $Y_n$ in the following operation steps.

As a result of generating large-size discharges in the above-described manner during the discharge sustaining period (V) of the first subfield, a desired light emission image is created. At the end of the discharge sustaining period (V) of the first subfield, there are negative and positive charges stored at the locations above the discharge sustaining electrodes $x_n$ and $y_n$, respeectively, in the discharging cells in which the sustaining discharge occurred. However, in the discharging cells in which no sustaining discharge occurred, there are no such charges at the location above the discharge sustaining electrodes $x_n$, and $y_n$. On the other hand, at the locations above the discharge sustaining electrodes $x'_n$ and $y'_n$, there are negative and positive charges remaining on the surface of the cathode film 5 regardless of the occurrence of the sustaining discharge. This is a situation at the end of the first subfield.

In the second subfield and the subfields following that, a similar sequence of operations is performed repeatedly. In the first priming period (I) of the second subfield, a discharge occurs in the small region limited between discharge sustaining electrodes $x_n$ and $y_n$ only in the discharging cells in which neither a writing discharge nor a sustaining discharge occurred in the first subfield. Also in this case, the discharge sustaining electrodes $x'_n$ and $y'_n$ make no contribution to the priming discharge during the first priming period (I) for the same reason described above with reference to the writing period (IV) in the first subfield.

As described above, in the second and following subfields, the sequence of operations are performed in a similar manner to the first subfield, and thus a great reduction is achieved in the intensity of light emission during the erasing discharge. As a result, the light emission contrast is improved.

Second Embodiment

This second embodiment is concerned with the technique to decrease the light emission intensity during the second priming period (II) of the second and following subfields in the operation of the plasma display panel.

In the first embodiment described above, the reduction in the intensity of light emission during the second priming period (II) is not achieved in the first subfield. Thus, no reduction is achieved in the second and following subfield. in this second embodiment, to solve the above problem, the voltage of the discharge sustaining electrode $x'_n$ is not swung to the highest voltage but is maintained at the intermediate voltage, as represented by the solid line in FIG. 2, during the second priming period (II) in the second and following subfields. Instead, the voltage of the discharge sustaining electrode $y'_n$ is swung from the GND voltage to the intermediate voltage.

In this technique, when a priming discharge occurs between the discharge sustaining electrodes $x_n$ and $y_n$ in the second priming period (II), the discharge no longer grows into the region between the discharge sustaining electrodes $x'_n$ and $y_n$ or into the region between the discharge sustaining electrodes $x_n$ and $y'_n$.

Therefore, in the second and following subfields, the discharge sustaining electrodes $x'_n$ and $y'_n$ make no contribution to the discharge during the second priming period (II) and the discharge is confined in the region limited between the discharge sustaining electrodes $x_n$ and $y_n$ and thus the discharge occurs in a small-size form unlike the discharge in the first subfield.

As described above, in the second and following subfields, the intensity of light emission due to the priming discharge in the second priming period (II), which is perceived by a user watching the plasma display panel, is reduced to a very low level and thus the influence of the light emission due to the priming discharge during the second priming period on the light emission contrast is suppressed. In this technique, therefore, the discharge sustaining electrodes $x'_n$ and $y'_n$ make no contribution to the discharge during the periods from the first priming period (I) to the writing period (IV) in the second and following subfields. At the beginning of the discharge sustaining period (V), therefore, the discharge sustaining electrodes $x'_n$ and $y'_n$ still hold the negative and positive charges which had been stored at the location above the discharge sustaining electrodes $x'_n$ and $y'_n$ at the end of the discharge sustaining period (V) in the previous subfield.

In this second embodiment, therefore, a desired image is created by the large-size sustaining discharges also in the second and following subfields based on the same principle as that described above with reference to the writing period (V) in the first subfield.

Third Embodiment

The third embodiment is concerned with the operation of the plasma display panel, at the stage where the second main frame starts after completion of all subfields (SF1–SF8) of the first main frame.

When the first subfield of the next main frame starts, the voltages to the discharge sustaining electrodes $x'_n$ and $y'_n$ during the second priming period (II) are applied in the manner represented by the alternate long and short dash lines in FIG. 2 as in the second priming period of the first main frame. However, such a large-size priming discharge in the second priming period (II) is undesirable because it has a bad influence on the light emission contrast, although it occurs only once in each main frame. In this third embodiment, to ease the above problem, the frequency of generating large-size priming discharges is decreased such that a discharge occurs every two or more main frames instead of every main frame thereby achieving an improvement in the light emission contrast.

Fourth Embodiment

The fourth embodiment is concerned with a particular operation of the plasma display panel in which the negative and positive charges, present on the surface of the cathode film 5 at the locations above the discharge sustaining electrodes $x'_n$ and $y'_n$ in discharging cells in which no discharge occurs in a decaying thereby ensuring that a discharge can occur in a correct fashion when the discharge is required.

If no discharge occurs at a particular pair of discharge sustaining electrodes $x'_n$ and $y'_n$ in the second priming period (II) over a very long succession of main frames, negative and positive charges at the locations above $x'_n$ and $y'_n$ are lost in a rather long time in those discharging cells in which no sustaining discharge occurs in the discharge sustaining period (V). This can produce a problem, because the software program controlling the operation of displaying an image on the plasma display panel has not the capability of dealing with such a loss of charge.

If the amount of the charge drops below a certain level, it becomes impossible for the discharge sustaining electrodes $x'_n$ and $y'_n$ to make contribution to the discharge in the discharge sustaining period (V) when such a cell is selected in the subsequent writing period (IV). In the case where the frequency of the priming discharge operations in the second priming period (II) is reduced, the priming discharge frequency becomes lower than the main frame frequency, and thus flicker noise becomes perceptible in particular at low halftone levels.

To improve the image quality, it is desirable to generate at least one priming discharge in the second priming period (II) in each main frame. Depending on a particular application in which the plasma display panel is used, it may be determined whether the light emission contrast or the image quality is considered as a more important factor in the design.

Fifth Embodiment

Figure 7:
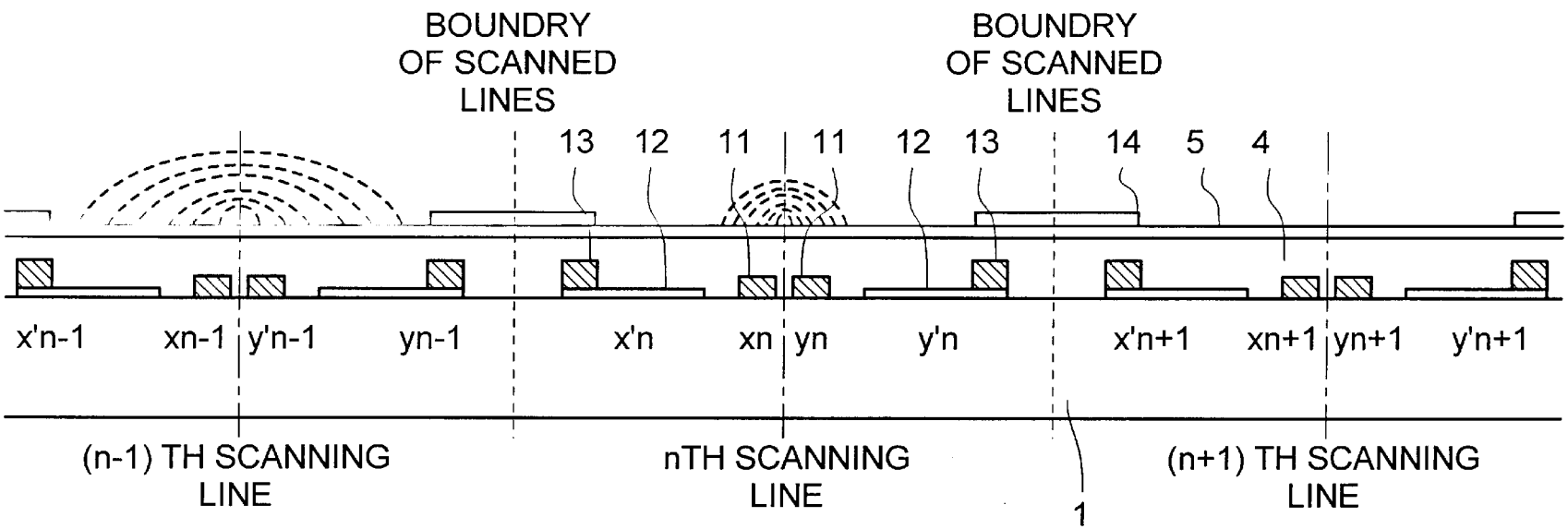
FIG. 7 is a cross-sectional view schematically illustrating the structure of a plasma display panel according to a fifth embodiment of the invention.

FIG. 7 is a cross-sectional view schematically illustrating the structure of a plasma display panel according to a fifth embodiment of the invention.

As shown in FIG. 7, on the back surface (the upper surface in FIG. 7) of a cathode film 5 uniformly formed over the entire surface of a dielectric layer 4 so that it serves as a protective film, there are provided discharge passivation films 14 extending along the respective boundaries between adjacent scanning lines so that the respective boundaries are prevented from being exposed directly to the discharge. The discharge passivation film 14 is formed mainly of a material such as $Al_2O_3$ or $TiO_2$ which is passive to discharging and transparent to light. In the areas along the respective boundaries between the adjacent scanning lines, the dielectric films 4 are protected from the gas discharging space by a two-layer film consisting of the discharge passivation film 14 and the cathode film 5.

Instead of employing the structure shown in FIG. 7, the discharge passivation film 14 may be formed directly on the dielectric layer 4 over its entire surface before forming the cathode film 5, and then the cathode film 5 maybe formed on the discharge passivation film 14 and patterned so that there is no cathode film 5 in the areas along the respective boundaries between adjacent scanning lines.

In this case, the passivation film is formed on the plasma display panel in such a manner that a two-layer protective film is provided at the central part of each scanning line and the discharge passivation film serving as a single-layer protective film is provided at each respective boundary between adjacent scanning lines.

In the plasma display panel according to the present invention, each discharge sustaining electrode $X_n$ or $Y_n$ is divided into two parts unlike the conventional structure in which each discharge sustaining electrode $X_n$ or $Y_n$ consists of one part, and thus the density of patterns such as discharge sustaining electrodes is twice that of the conventional structure.

In the structure having a high density of discharge sustaining electrodes, it becomes difficult to have wide enough spaces between the discharge sustaining electrodes $x'_{n+1}$ and y' located at both sides of the boundary between adjacent scanning lines so that there is no interference between adjacent discharges. However, the above problem can be avoided by employing the discharge passivation film 14, since this film has, as described in detail in previous patents (Japanese Patents Laid-Open Nos. 7-256262, 9-102280) filed by the same applicant for the present invention, the ability of suppressing the interference between adjacent discharges occurring at the boundary between adjacent scanning lines. That is, the above structure with the discharge passivation film 14 is particularly useful to achieve a high density of scanning lines.

Sixth Embodiment

Figure 8:
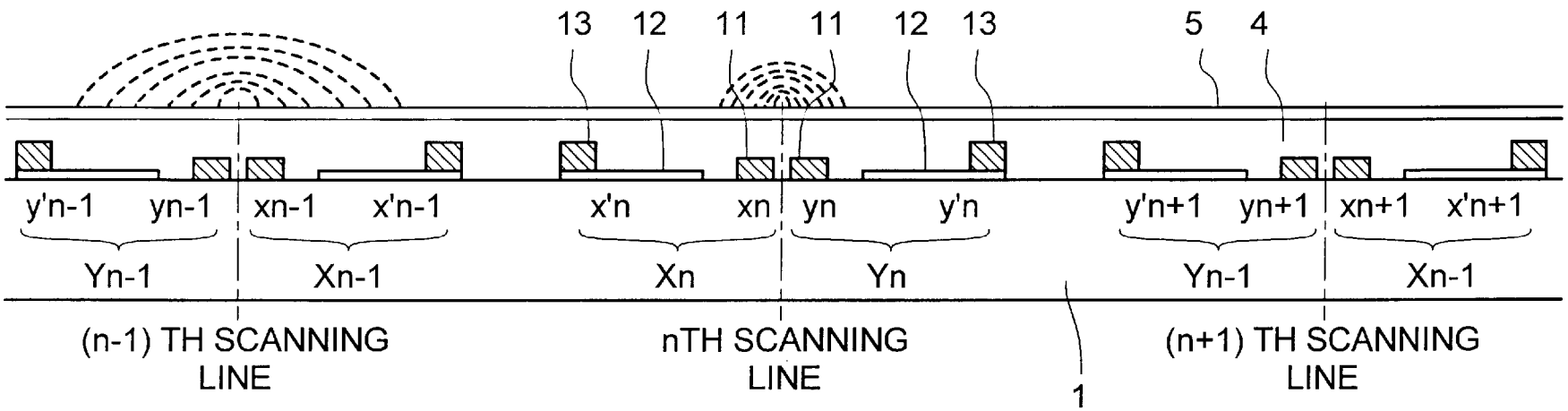
FIG. 8 is a cross-sectional view schematically illustrating the structure of a plasm a display device according to a sixth embodiment of the present invention.

FIG. 8 is a cross-sectional view schematically illustrating the structure of a plasma display device according to a sixth embodiment of the present invention.

As described in FIGS. 1 and 7, each scanning line consists of electrically-isolated discharge sustaining electrodes located in the order $x'_n$, $x_n$, $y_n$, and $y'_n$ or $y'_n$, $y_n$, $x_n$, and $x'_n$ in a direction toward a greater value of scanning line number n.

It is generally required to form terminals on the front glass substrate 1 so that the discharge sustaining electrodes are connected to the external electrodes through the terminals. To prevent the adjacent terminals from having a voltage difference at a high frequency, it is desirable that electrodes $\{x'_n\}$ and $\{x_n\}$ extend in parallel along the same direction and that electrodes $\{y_n\}$ and $\{y'_n\}$ extend in parallel in the direction different from the direction of $\{x'_n\}$ and $\{x_n\}$.

However, in the structures of discharge sustaining electrodes shown in FIGS. 1 and 7, the density of the terminal patterns is also twice that of the conventional structure. Therefore, the increase in the scanning line density brings about difficulty in making connections of the high-density terminals in the assembling process.

In this sixth embodiment of the plasma display panel, to avoid the above problem, electrically isolated discharge sustaining electrodes are disposed in one scanning line in the order $x'_n$, $x_n$, $y_n$, and $y'_n$ in the direction in which the scanning line number n increases, while electrodes are disposed in the order $y'_n$, $y_n$, $x_n$, and $x'_n$ in an adjacent scanning line. Scanning lines having these two different arrangements of the discharge sustaining electrodes are alternately disposed.

In this structure, the discharge sustaining electrodes $\{x'_n\}$ and $\{x_n\}$ extend toward the terminals in the order . . . , $x_{n-1}$, $x'_{n-1}$, $x'_n$, $x_n$, $x_{n+1}$, $x'_{n+1}$, . . . and thus it is possible to connect adjacent discharge sustaining electrodes x' together and connect adjacent discharge sustaining electrodes x together. As a result, the density of terminals can be reduced to a similar to that of the conventional structure (half that of the structure shown in FIGS. 1 or 7).

Similarly, the discharge sustaining electrodes $\{y'_n\}$ and $\{y_n\}$ extend toward the terminals in the order . . . , $y'_{n-1}$, $y_{n-1}$, $y_n$, $y'_n$, $y'_{n+1}$, $y_{n+1}$, . . . and thus it is possible to connect adjacent discharge sustaining electrodes y' together thereby reducing the terminal density to a level about 1.5 times that of the conventional structure (¾ times that of the structure shown in FIGS. 1 or 7).

As described above, in the sixth embodiment of the plasma display panel according to the invention, the pattern density is increased without causing a significant increase in the terminal density thereby achieving a high-performance plasma display panel which can be easily produced.

Seventh Embodiment

Figure 9:
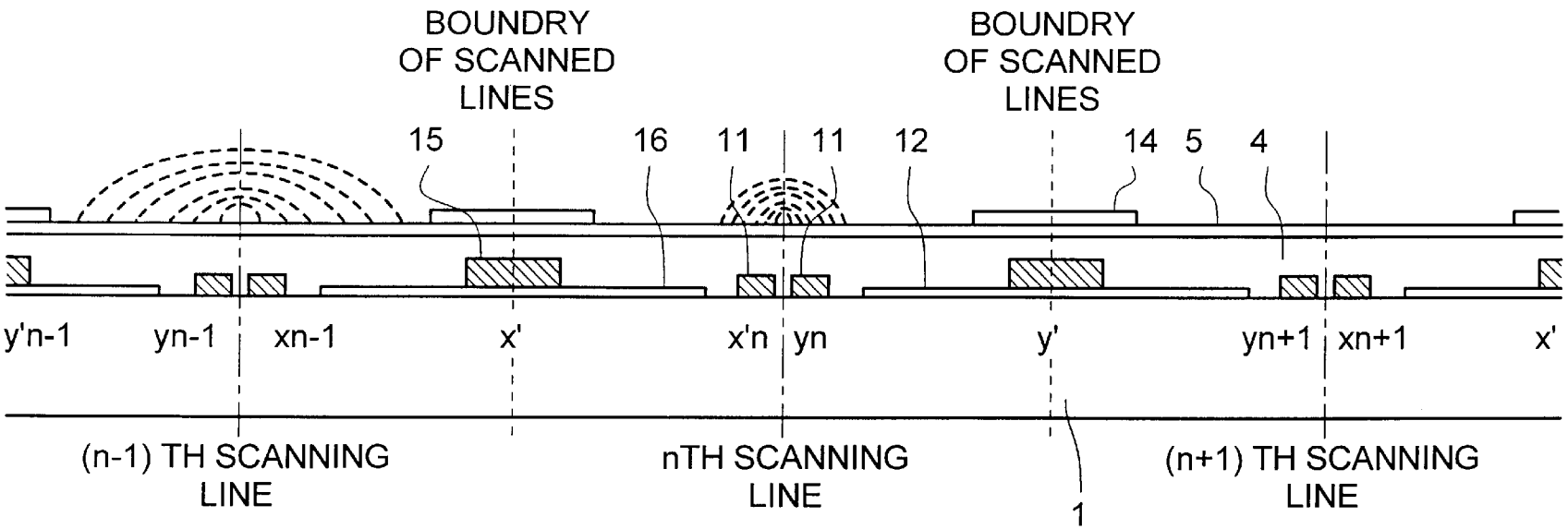
FIG. 9 is a cross-sectional view schematically illustrating the structure of a plasma display device according to a seventh embodiment of the present invention.

FIG. 9 is a cross-sectional view schematically illustrating the structure of a plasma display device according to a seventh embodiment of the present invention.

As shown in FIG. 9, there is provided an electrode x' serving as a common discharge sustaining electrode 15 disposed between adjacent discharge sustaining electrodes $x_n$ and $x_{n-1}$, and there is provided an electrode y' also serving as a common discharge sustaining electrode disposed between adjacent discharge sustaining electrodes $y_n$ and $y_{n-1}$, wherein common bus electrodes 15 (x', y') are formed on a transparent electrode 16 which is formed at a boundary between adjacent scanning line so that it is shared by the adjacent scanning lines.

In contrast to the structure shown in FIG. 8 in which $x'_n$ and $x'_{n-1}$ are adjacent to each other via a boundary of adjacent scanning lines and $y'_n$ and $y'_{n-1}$ are adjacent to each other via a boundary of adjacent scanning lines, the present embodiment has the structure in which the electrode x' or y' is formed at the boundary between adjacent scanning lines so that it is shared by the adjacent scanning lines. However, as described in detail in a previous patent (Japanese Patent Laid-Open No. 9-60930) filed by the same applicant for the present invention, this structure is not effective enough to prevent discharging interference from occurring at the boundary between adjacent scanning lines. To ensure that the discharging interference is prevented, there is provided, as in the fifth embodiment (refer to FIG. 7), a discharge passivation film 14 made of a material passive to discharging, disposed on the back side of the cathode film 5 at the locations corresponding to the boundaries between adjacent scanning lines.

In contrast to the structures according to the first to sixth embodiments in which the pattern density of the bus electrodes 15 is twice that of the conventional structure, the seventh embodiment has a bus electrode pattern density reduced to a level about 1.5 times that of the conventional structure.

Thus, the structure according to the seventh embodiment is useful to achieve a high density of scanning lines.

If the ratio of the area occupied by the bus electrodes which block the light emitted from the phosphors 8 to the total area increases with the increase in the density of the scanning lines, the light emission efficiency decreases. This problem can also be suppressed to a great extent in this seventh embodiment.

That is, in this structure according to the seventh embodiment in which the common bus electrodes 15 (x', y') shared by adjacent scanning lines are disposed at the boundaries between adjacent scanning lines, the presence of the common bus electrodes 15 (x', y') does not cause a significant reduction in the light transmission efficiency because the common bus electrodes 15 (x' y') are disposed at locations where light emission from the phosphor 8 is weak. Furthermore, the presence of the single line of the large-width common bus electrode 15 (x', y'), which is opaque and disposed at each boundary, blocks the light at boundaries, and thus light emission cells are physically isolated from each other. This results in an improvement in isolation among picture elements of an image and thus an improvement in the image quality.

Furthermore, the width of the common bus electrodes 15 can be increased by an amount corresponding to the lost gap at the boundary between adjacent discharge sustaining electrodes, and more specifically to twice that of the bus electrodes 13 employed in the first to sixth embodiments. The bus electrodes with the increased width are suitable for use in the discharge sustaining electrodes x' and y' which need to pass a greater amount of current than the discharge sustaining electrodes x and y.

As described above the present invention provides the plasma display panel having the following advantages. That is, the plasma display panel comprises: a back side glass plate on which there is provided an address electrode; a front glass plate located opposite to the back side glass plate; and a plurality of discharge sustaining electrode pairs provided on the front glass plate in such a manner that they extend along scanning lines perpendicular to the address electrode, wherein the discharge sustaining electrodes $X_n$ and $Y_n$ of each discharge sustaining electrode pair comprise discharge sustaining electrodes $x'_n$ and $x_n$, and $y_n$ and $y'_n$, respectively, which are electrically isolated from each other and which extend in a direction along the scanning lines. In this structure, a discharge occurs basically in a small region limited between the discharge sustaining electrodes $x_n$ and $y_n$ in the priming and erasing discharge periods thereby reducing the intensity of black level thus improving the light emission contrast. Furthermore, the power dissipation is also reduced.

Furthermore, since the discharge sustaining electrodes $x_n$ and $y_n$ have the property of blocking light and the discharge sustaining electrodes $x'_n$ and $y'_n$ are provided with a transparent electrode, when a discharge occurs only in the small region limited between the discharge sustaining electrodes $x_n$ and $y_n$, the light emitted from the phosphor in response to such a discharge is blocked by the electrode having the property of blocking light. On the other hand, when a discharge occurs over the entire region including all discharge sustaining electrodes $x_n$, $x'_n$, $y_n$, and $y'_n$, it is possible to achieve as high a visible light intensity level as obtained in the conventional technique.

Furthermore, the electrically isolated discharge sustaining electrodes are disposed in the order $x'_n$, $x_n$, $y_n$, $y'_n$ or in the order $y'_n$, $y_n$, $x_n$, $x'_n$ in a direction in which the scanning line number n increases (where n is a natural number). This makes it possible to generate a discharge in either mode. That is, it is possible to generate a discharge within a small region limited between the discharge sustaining electrodes $x_n$ and $y_n$ and also possible to generate a discharge over the entire region including all discharge sustaining electrodes $x_n$, $x'_n$, $y_n$, and $y'_n$.

Furthermore, when a priming pulse and an erasing pulse are applied to the discharge sustaining electrodes $x_n$ and $y_n$ in driving operation, the priming pulse and the erasing pulse are not always applied to the discharge sustaining electrodes $x'_n$ and $y'_n$. As a result, priming and erasing discharges occur in a small region, which results in an improvement in the light emission contrast.

In the preferred mode of the invention, no erasing pulse is applied to the discharge sustaining electrodes $x'_n$ and $y'_n$. As a result, erasing discharges occur in a small region, and thus the light emission contrast is improved.

Furthermore, in the preferred mode in which a priming pulse is applied to the discharge sustaining electrodes $x'_n$ and $y'_n$ only in one subfield of each main frame consisting of a plurality of subfields, the light emission contrast is improved without causing degradation in the image quality.

In the preferred mode in which a series of main frames each consisting of a plurality of subfields is constructed so that in some of the main frames no priming pulse is applied to the discharge sustaining electrodes $x'_n$ and $y'_n$, the light emission contrast is further improved.

Furthermore, when image data is written via the address electrode while sequentially scanning the scanning lines, a discharge occurs only in the region limited between the discharge sustaining electrodes $x_n$ and $y_n$ and the discharge sustaining electrodes $x'_n$ and $y'_n$ make no contribution to the discharge. This allows a reduction in the power dissipation.

In the preferred mode in which the plasma display panel further includes a dielectric layer covering the discharge sustaining electrode pair $X_n$ and $Y_n$; and a protective film covering the dielectric layer, wherein passivation films are formed of a material passive to discharging on the back-side surface of the protective film in such a manner that each passive film extends along each boundary between adjacent scanning lines, it is possible to suppress interference between adjacent dischargers. Furthermore, it is also possible to ease the increase in the density of terminals connected to the discharge sustaining electrodes.

In another preferred mode, first types of scanning lines and second types scanning lines are alternately disposed, wherein each first type of scanning line comprises electrically isolated discharge sustaining electrodes disposed in the order $x'_n$, $x_n$, $y_n$ in a direction in which the scanning line number n increases and wherein each second type of scanning line comprises electrically isolated discharge sustaining electrodes disposed in the order $y'_n$, $y_n$, $x_n$, and $x'_n$ in the direction in which the scanning line number n increases. This structure is useful to suppress discharging interference between adjacent scanning lines and also to deal with the increase in the density of scanning lines.

In the preferred mode in which at least either discharge sustaining electrode $x'_n$ or $y'_n$ includes a part located at the boundary between adjacent scanning lines and shared by the adjacent scanning lines, it is possible to ease the increase in the pattern density of bus electrodes. Furthermore, the light emission efficiency is improved, and picture elements are clearly isolated from each other. Still furthermore, it is possible to increase the maximum allowable current passing through x' and y'.

What is claimed is:

1. A plasma display panel comprising: a back side glass plate on which there is provided an address electrode; a front glass plate located opposite to said back side glass plate; and a plurality of discharge sustaining electrode pairs provided on said front glass plate in such a manner that they extend along scanning lines perpendicular to said address electrode, wherein the discharge sustaining electrodes $X_n$ and $Y_n$ of each discharge sustaining electrode pair comprise discharge sustaining electrodes $x'_n$ and $x_n$, and $y_n$ and $y'_n$, respectively, which are electrically isolated from each other and which extend in a direction along the scanning lines.

2. A plasma display panel according to claim 1, wherein said discharge sustaining electrodes $x_n$ and $y_n$ have the property of blocking light and said discharge sustaining electrodes $x'_n$ and $y'_n$ are provided with a transparent electrode.

3. A plasma display panel according to claim 1, wherein said electrically isolated discharge sustaining electrodes are disposed in the order $x'_n$, $x_n$, $y_n$, $y'_n$ or in the order $y'_n$, $y_n$, $x_n$, $x'_n$ in a direction in which the scanning line number n increases (where n is a natural number).

4. A plasma display panel according to claim 3, wherein when a priming pulse and an erasing pulse are applied to said discharge sustaining electrodes $x_n$ and $y_n$ in driving operation, the priming pulse and the erasing pulse are not always applied to said discharge sustaining electrodes $x'_n$ and $y'_n$.

5. A plasma display panel according to claim 4, wherein no erasing pulse is applied to said discharge sustaining electrodes $x'_n$ and $y'_n$.

6. A plasma display panel according to claim 4, wherein a priming pulse is applied to said discharge sustaining electrodes $x'_n$ and $y'_n$ only in one subfield of each main frame consisting of a plurality of subfields.

7. A plasma display panel according to claim 4, wherein a series of main frames each consisting of a plurality of subfields is constructed so that in some of said main frames no priming pulse is applied to said discharge sustaining electrodes $x'_n$ and $y'_n$.

8. A plasma display panel according to claim 4, wherein when image data is written via the address electrode while sequentially scanning said scanning lines, a discharge occurs only in the region limited between said discharge sustaining electrodes $x_n$ and $y_n$ and said discharge sustaining electrodes $x'_n$ and $y'_n$ make no contribution to the discharge.

9. A plasma display panel according to claim 1, further comprising: a dielectric layer covering said discharge sustaining electrode pair $X_n$ and $Y_n$; and a protective film covering said dielectric layer, wherein passivation films are formed of a material passive to discharging on the back-side surface of said protective film in such a manner that each said passivation film extends along each boundary between adjacent scanning lines.

10. A plasma display panel according to claim 4, wherein first types of scanning lines and second types scanning lines are alternately disposed, each said first type of scanning line comprising electrically isolated discharge sustaining electrodes disposed in the order $X'_n$, $X_n$, $Y_n$, and $Y'_n$ in a direction in which the scanning line number n increases, each said second type of scanning line comprising electrically isolated discharge sustaining electrodes disposed in the order $Y'_n$, $Y_n$, $X_n$, and $X'_n$ in the direction in which the scanning line number n increases.

11. A plasma display panel according to claim 10, wherein at least either discharge sustaining electrode $x'_n$ or $y'_n$ includes a part located at the boundary between adjacent scanning lines and shared by said adjacent scanning lines.

* * * * *

UNITED STATES PATENT AND TRADEMARK OFFICE

CERTIFICATE OF CORRECTION

PATENT NO. : 6,031,329
DATED : February 29, 2000
INVENTOR(S) : Nagano

It is certified that error appears in the above-identified patent and that said Letters Patent is hereby corrected as shown below:

In Fig. 1, change "(N-1) TH" to -- (n-1) TH --; "NTH" to -- nTH --; and "(N+1) TH" to -- (n+1) TH --.

In Fig. 2, change the upper "[Vn]Xn'" to -- [$^{\forall}$ n]x'n --.

In Fig. 2, change the lower "[Vn]Xn'" to -- [$^{\forall}$ n]xn --.

Figure 4:
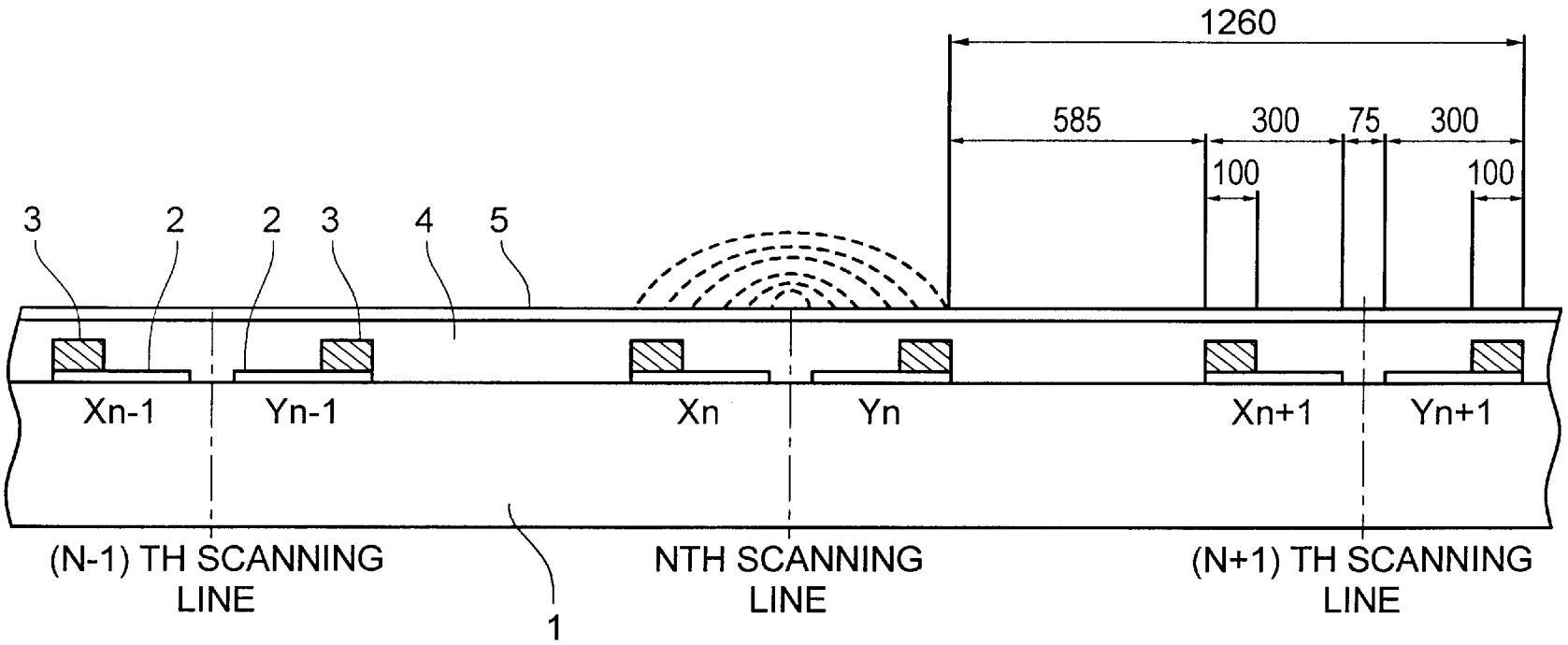
FIG. 4 (PRIOR ART)
FIG. 4 illustrates a cross section of the conventional plasma display panel, taken along a plane perpendicular to the scanning lines.

In Fig. 4, change "(N-1) TH" to -- (n-1) TH --; "NTH" to -- nTH --; and "(N+1) TH" to -- (n+1) TH --.

In Fig. 6, change "[Vn]Xn'" to -- [$^{\forall}$ n]xn --.

In Fig. 8, change "Yn-1" to -- Yn+1 --; and "Xn-1" to -- Xn+1 --.

In column 4, line 36, change "$x'_n$, $x_n$, $y_n$" to -- $x'_n$, $x_n$, $y_n$, $y'_n$ --.

In column 5, line 26, change "$x_n$, $x'_n$, $y_n$, and $y'_n$" to -- $x'_n$, $x_n$, $y_n$ and $y'_n$ --.

In column 12, line 9, change "y'" to -- $y'_n$ --.

In column 12, line 14, change "Nos. 7-256262. 9-102280)" to -- No. 9-102280) --.

In column 13, line 27, change "No. 9-60930)" to -- No. 10-255664 --.

In column 15, line 24, change "$x'_n$, $x_n$, $y_n$" to -- $x'_n$, $x_n$, $y_n$, $y'_n$ --.

UNITED STATES PATENT AND TRADEMARK OFFICE

CERTIFICATE OF CORRECTION

PATENT NO. : 6,031,329
DATED : February 29, 2000
INVENTOR(S) : Nagano

It is certified that error appears in the above-identified patent and that said Letters Patent is hereby corrected as shown below:

In column 16, line 44 (claim 10), change "$X'_n$, $X_n$, $Y_n$, and $Y'_n$" to -- $x'_n$, $x_n$, $y_n$, and $y'_n$ --.

In column 16, line 48 (claim 10), change "$Y'_n$, $Y_n$, $X_n$, and $X'_n$" to -- $y'_n$, $y_n$, $x_n$, and $X'_n$ --.

In column 3, line 49, change "andapluralityofdischarge" to -- and a plurality of discharge --.

In column 4, line 24, change "formof" to -- form of --.

In column 5, line 5, change "plasm a" to -- plasma --.

In column 7, line 4, change "$X_n$" to -- $x_n$ --.

In column 7, line 20, change "x" to -- $x_n$ --.

Signed and Sealed this

Tenth Day of April, 2001

*Attest:*

Nicholas P. Godici

NICHOLAS P. GODICI

*Attesting Officer*

*Acting Director of the United States Patent and Trademark Office*